US007056442B2

(12) United States Patent
Hansen

(10) Patent No.: US 7,056,442 B2
(45) Date of Patent: Jun. 6, 2006

(54) METHOD AND APPARATUS FOR FLUSHING CONTAMINANTS FROM A CONTAINER OF FLUIDS

(76) Inventor: Dennis B. Hansen, 2424 Highway 24, New Hampton, IA (US) 50659

( * ) Notice: Subject to any disclaimer, the term of this patent is extended or adjusted under 35 U.S.C. 154(b) by 0 days.

(21) Appl. No.: 10/064,822

(22) Filed: Aug. 21, 2002

(65) Prior Publication Data

US 2004/0035805 A1 Feb. 26, 2004

(51) Int. Cl.
*B01D 37/00* (2006.01)

(52) U.S. Cl. ..... 210/805; 210/168; 210/138; 210/196; 210/416.5; 210/427; 134/22.12; 134/102.2; 134/103.1

(58) Field of Classification Search ..... 134/22.1, 134/22.11, 22.12, 22.18, 34–35, 37, 42, 102.2, 134/103.1; 210/767, 790, 805, 108, 138, 210/139, 167, 168, 181, 196, 258, 416.1, 210/427, 455

See application file for complete search history.

(56) References Cited

U.S. PATENT DOCUMENTS

| | | | | |
|---|---|---|---|---|
| 1,906,417 | A | 5/1933 | Renfrew et al. | |
| 2,302,489 | A | 11/1942 | Brown | |
| 2,425,848 | A | 8/1947 | Vawter | |
| 2,499,705 | A | 3/1950 | Vokes | |
| 2,619,974 | A | 12/1952 | Daley et al. | |
| 2,635,756 | A | 4/1953 | Grieve et al. | |
| 3,489,245 | A | 1/1970 | Broadwell | |
| 3,561,489 | A * | 2/1971 | Furrer | 137/625.63 |
| 4,113,627 | A | 9/1978 | Leason | |
| 4,114,650 | A * | 9/1978 | Gordon | 137/625.63 |
| 4,127,160 | A | 11/1978 | Joffe | |
| 4,161,979 | A | 7/1979 | Stearns | |
| 4,217,221 | A | 8/1980 | Masso | |
| 4,366,003 | A | 12/1982 | Korte et al. | |
| 4,390,049 | A | 6/1983 | Albertson | |
| 4,645,542 | A | 2/1987 | Scharton et al. | |
| 4,790,882 | A | 12/1988 | Barres | |
| 4,791,890 | A | 12/1988 | Miles et al. | |
| 4,971,704 | A | 11/1990 | Johnson, Sr. | |
| 5,063,896 | A | 11/1991 | Hyatt et al. | |

(Continued)

FOREIGN PATENT DOCUMENTS

| | | |
|---|---|---|
| JP | 59-201919 | 11/1984 |

*Primary Examiner*—Robert James Popovics
*Assistant Examiner*—T. Woodruff
(74) *Attorney, Agent, or Firm*—Simmons Perrine Albright & Ellwood PLC

(57) ABSTRACT

A contaminant-flushing machine for removing contaminants from a container, such as an engine transmission, air-conditioner coil, or transmission cooler, which includes hoses for coupling to the transmission cooler and a pump for circulating fluid through the hoses and the transmission cooler, and a fluid filter having a reduced tendency towards causing vaporization of the fluid. Also included in the contaminant-flushing machine is an automatic aeration system for injecting air into the circulating fluid at predetermined intervals. Additionally, a reverse flow piping circuit is included to permit automatic and electric manipulation of the flow direction of fluid through said transmission cooler while at the same time not altering the direction of flow of fluid through the pump. The flow reversals are repeated with a cycle of three (3) seconds in one direction followed by a flow in the other direction of one-fourth (¼) of a second, thereby creating an overall flow of fluid primarily in one reverse direction. The bursts of air are less than one (1) second and occur at five (5) second intervals.

24 Claims, 4 Drawing Sheets

U.S. PATENT DOCUMENTS

| | | | | |
|---|---|---|---|---|
| 5,159,956 | A | 11/1992 | Kurihara | |
| 5,178,763 | A | 1/1993 | Delaunay | |
| 5,383,481 | A | 1/1995 | Waelput | |
| 5,443,085 | A | 8/1995 | Huddas | |
| 5,615,695 | A | 4/1997 | Chambers | |
| 5,674,323 | A | 10/1997 | Garcia | |
| 5,680,877 | A | 10/1997 | Edstrand et al. | |
| 5,699,817 | A | 12/1997 | Bankert et al. | |
| 5,706,841 | A | 1/1998 | Werre et al. | |
| 6,213,133 | B1 * | 4/2001 | Reicks | 134/22.1 |
| 6,379,540 | B1 | 4/2002 | Reicks | |
| 6,796,339 | B1 * | 9/2004 | Petty | 141/65 |
| 2004/0035805 | A1 * | 2/2004 | Hansen | 210/774 |

* cited by examiner

METHOD AND APPARATUS FOR FLUSHING CONTAMINANTS FROM A CONTAINER OF FLUIDS

BACKGROUND OF INVENTION

The present invention generally relates to fluid filtering, and more particularly relates to a method and apparatus for removing contaminants from a container having petroleum-based fluids therein, through a process of circulating, heating and filtering such fluids outside of the container.

In the past, automotive engineers and technicians have been among the many people to recognize the need for an ability to flush contaminants from fluid-containing enclosures or systems. One example of such a fluid-containing system is a transmission/transmission cooler system in which transmission fluid therein is normally cooled during operation of a vehicle by passing the transmission fluid through the transmission cooler. Such systems frequently contain tiny metal shavings resulting from wear of internal parts. It is desirable to provide an effective way to remove such metal shavings and other contaminants from the system without the need for completely dismantling the transmission and cooling system.

Systems for extracting transmission fluid from the system, then heating it and circulating this fluid through an external filter to thereby flush out contaminants from the transmission and cooling system, have enjoyed considerable success in the past. However, these systems have had several drawbacks. Examples of such a system are described in U.S. Pat. Nos. 6,213,133 and 6,379,540 issued to Dan Reicks. These systems can often take an extended period of time to maximize the removal of contaminants and sediment. This limits the usefulness of such systems, especially for use on vehicles which are generally in revenue-generating service. Finally, these systems have often required considerable attention by a trained operator during performance of the flushing operations.

Consequently, there exists a need for improved methods and apparatuses for flushing contaminants from a fluid container.

SUMMARY OF INVENTION

It is an object of the present invention to provide enhanced ability to clean contaminants and sediment from a fluid container.

It is a feature of the present invention to include a rapidly reversing flow-switching mechanism in a contaminant-flushing apparatus.

It is an advantage of the present invention to reduce the time consumed and complexity involved in reversing a flow direction during the flushing process.

It is another object of the present invention to provide for increased in-field utilization of a flushing system.

It is another feature of the present invention to include a fluid aeration mechanism with micro-bursts of air.

It is another advantage of the present invention to provide for a reduced overall time required to perform the flushing operation and thereby increase the overall in field utilization of the flushing equipment of the present invention.

It is yet another advantage of the present invention to greatly reduce oil misting which evaporates oil into the air.

The present invention is an improved method and apparatus for removing contaminants from a container having fluids and contaminants therein, designed to satisfy the aforementioned needs, provide the previously stated objects, include the above-listed features, and achieve the already articulated advantages. The present invention is carried out in a "wasted time-less" operation in the sense that a substantial reduction in time required to perform the filtering and flushing is achieved. The present invention is further carried out in a "wasted oil-less" manner in the sense that a substantial reduction in oil misting or oil evaporation is achieved with the present invention.

Accordingly, the present invention is a method and apparatus for flushing contaminants from a fluid container comprising a pump, a fluid heater, and apparatus for injecting micro-bursts of air into the fluid.

In an alternate embodiment, the present invention includes a pump, a heater, and a flow direction-switching mechanism for reversing the flow of fluid through a container having contaminants therein and for re-reversing the flow direction in a rapid manner.

BRIEF DESCRIPTION OF DRAWINGS

The invention may be more fully understood by reading the following description of preferred embodiments of the invention, in conjunction with the appended drawings wherein.

DETAILED DESCRIPTION

Figure 1:
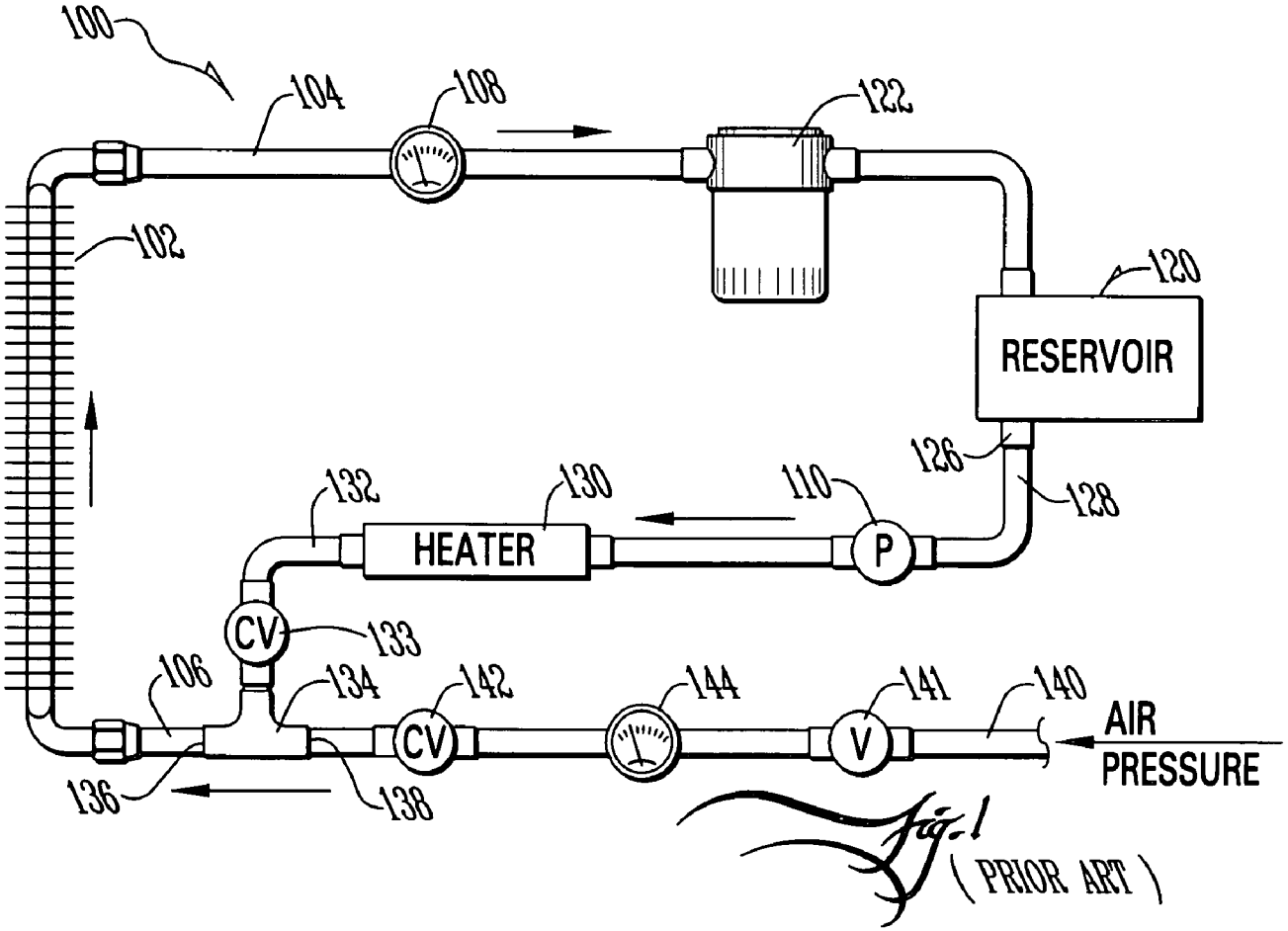
Fig. 1 (PRIOR ART)
FIG. 1 is a simplified diagram showing a prior art contaminant-flushing machine.

Now referring to the drawings, wherein like numerals refer to like matter throughout, and more particularly to FIG. 1, there is shown a simplified diagram of a prior art contaminant-flushing machine, generally designated 100, which is coupled to an automobile transmission cooler 102 by connecting hoses 104 and 106. Hoses 104 and 106 may be special heat-resistant hoses or other types. Additionally, hoses may be replaced with pipes (flexible or not), tubes, or any structure capable of carrying fluid under pressure. Hose 104 is coupled to temperature gauge 108. Also shown is a reservoir 120 which receives transmission fluid from line 104 by first passing such fluid through filter 122. Transmission fluid is disposed in the reservoir which will be extracted through port 126 and line 128 by pump 110. As the transmission fluid is pumped through pump 110 and on to heater 130, it is pressurized and heated to predetermined levels. Exiting from heater 130 is line 132, which is coupled through check valve 133 to "T" coupling 134, which has an exit port 136, as well as an air-cleaning port 138. Air-cleaning port 138 is coupled to air line 140, which is available from an air compressor (not shown). Disposed between air line 140 and port 138 is a check valve 142, which prohibits transmission fluid from being exhausted from the system through the air line 140. Additionally, there is shown a pressure gauge 144 for measuring the pressure inside the line 140 and a manual valve 141 for selectively coupling the air line 140 with "T" coupling 134. The purpose of the assembly 134, 138, 140, 142 and 144 is to permit easy purging of any transmission oil left in the lines after the flushing process has been completed. Exit port 136 is directly coupled to line 106, which enters the transmission cooler 102. The terms "lines", "pipes", "hoses", or "tubes" may be used interchangeably herein. They are intended to reflect the many possible structures which could be used to transport fluids.

Figure 2:
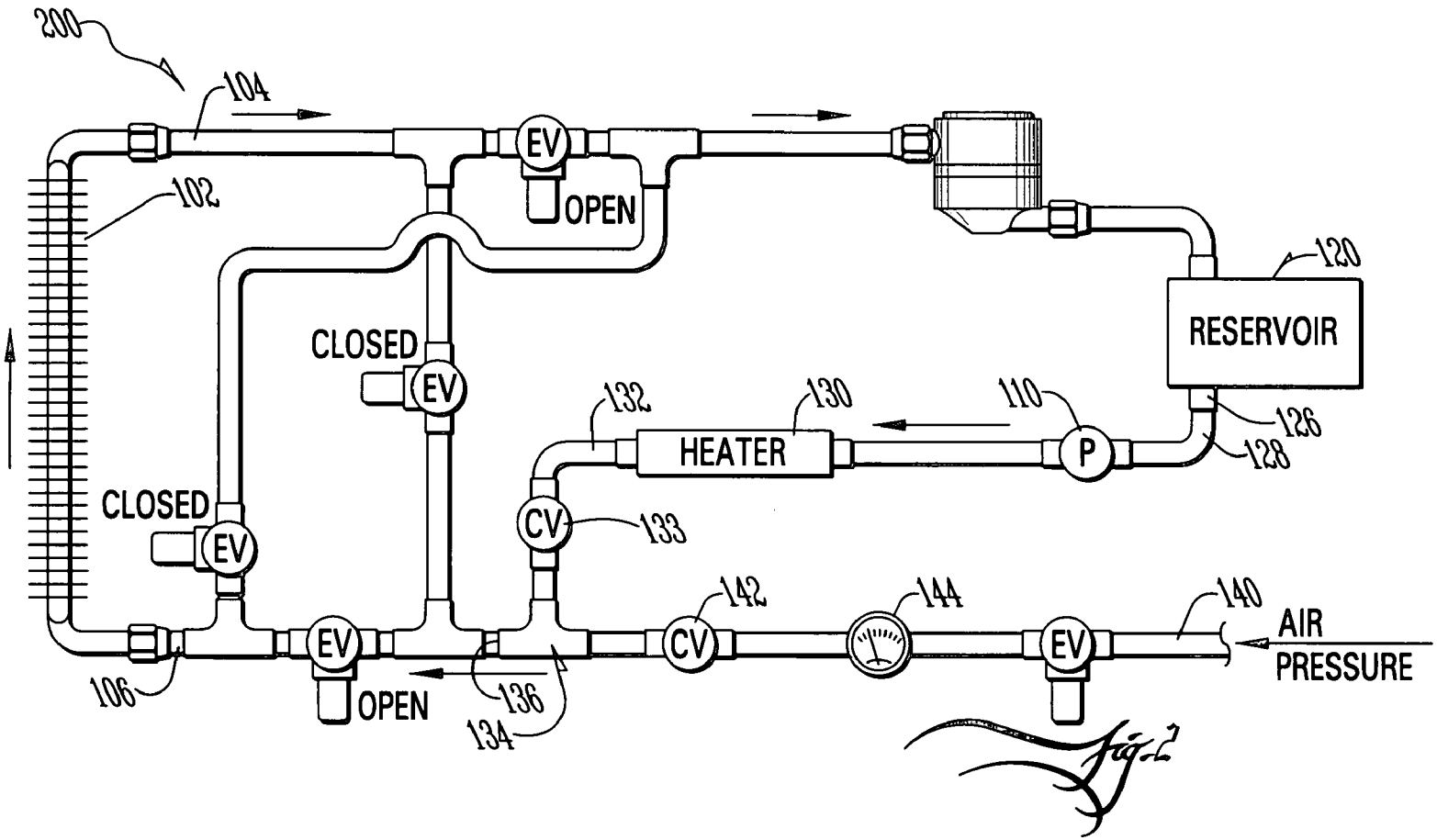
FIG. 2 is a simplified diagram of a contaminant-flushing machine of the prior art, including a reverse flow valve circuit and an automatic aeration control assembly.

Now referring to FIG. 2, there is shown a simplified diagram of a contaminant-flushing machine of the prior art, generally designated 200, which is coupled to an automobile transmission cooler 102 by connecting hoses 104 and 106.

Figure 3:
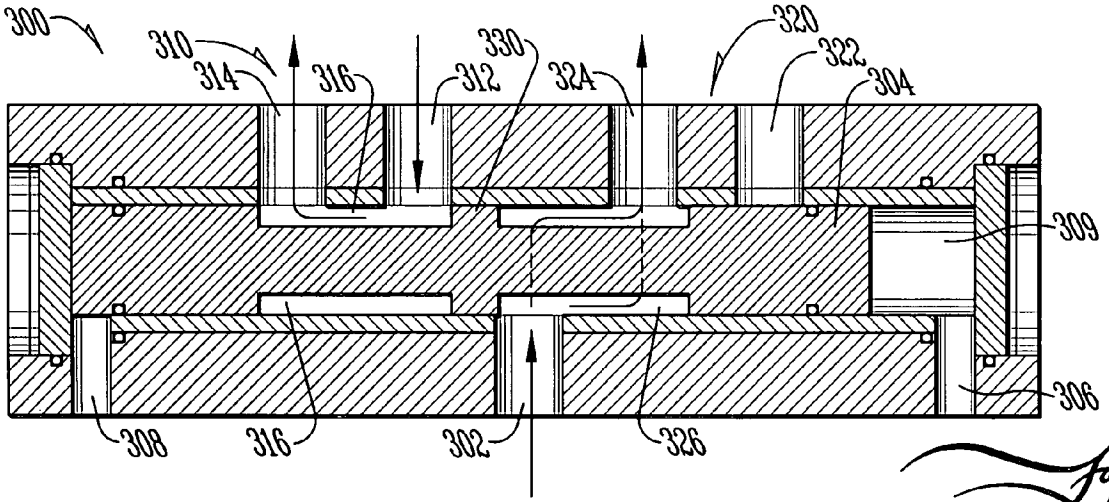
FIG. 3 is a cross-sectional view of an alternating dual-output high-speed valve of the present invention with the movable piston disposed in a leftward position.

Now referring to FIG. 3, there is shown a cross-sectional diagram of a high-speed valve of the present invention, generally designated 300, including an input port 302, a movable piston 304 and a first outlet port 310 and a second outlet port 320. Piston 304 includes a central full-width sealing region 330, which separates first port flow region 316 and second port flow region 326. When piston 304 is disposed to the left, the central full-width sealing region 330 blocks flow of fluid to first outlet port 310. Second port flow region 326 permits fluid to flow out second outlet port first opening 324 of second outlet port 320. Movable piston 304 is moved to the left when compressed air is provided at second end air port 306 so as to create second end air expansion area 309. When movable piston 304 is disposed to the left, then first outlet port second opening 314 and first outlet port first opening 312 are coupled together via first port flow region 316.

Figure 4:
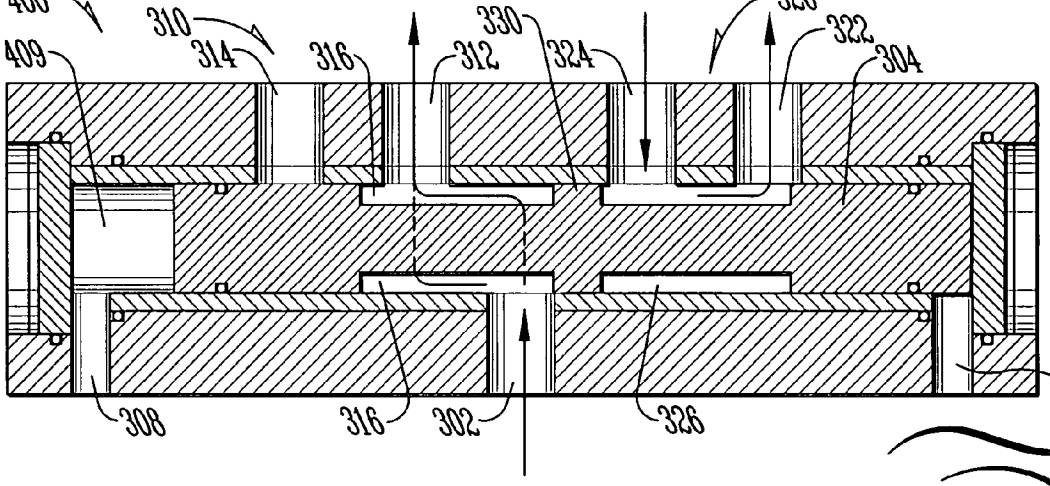
FIG. 4 is another cross-sectional view of the alternating dual-output high-speed valve of FIG. 3 with the movable piston disposed in a rightward position.

Now referring to FIG. 4, there is shown another view of the valve 300, generally designated 400, where movable piston 304 is disposed to the right after air has been supplied to first end air port 308. In such a configuration, fluid is able to flow into input port 302 and out of first outlet port first opening 312 because they are connected by first port flow region 316. In a preferred embodiment, central full-width sealing region 330 is longer than a width dimension of input port 302. This eliminates the possibility that fluid could be permitted to flow from first outlet port 310 and second outlet port 320 simultaneously while the valve is being switched. When movable piston 304 is disposed to the right by providing air pressure to first end air port 308, causing first end air expansion area 409 to expand, then second outlet port second opening 322 and second outlet port first opening 324 are now coupled together via second port flow region 326.

The valve 300 could be made in many different ways; however, it is believed that the use of an air-driven piston valve best meets the needs of the present invention.

Figure 5:
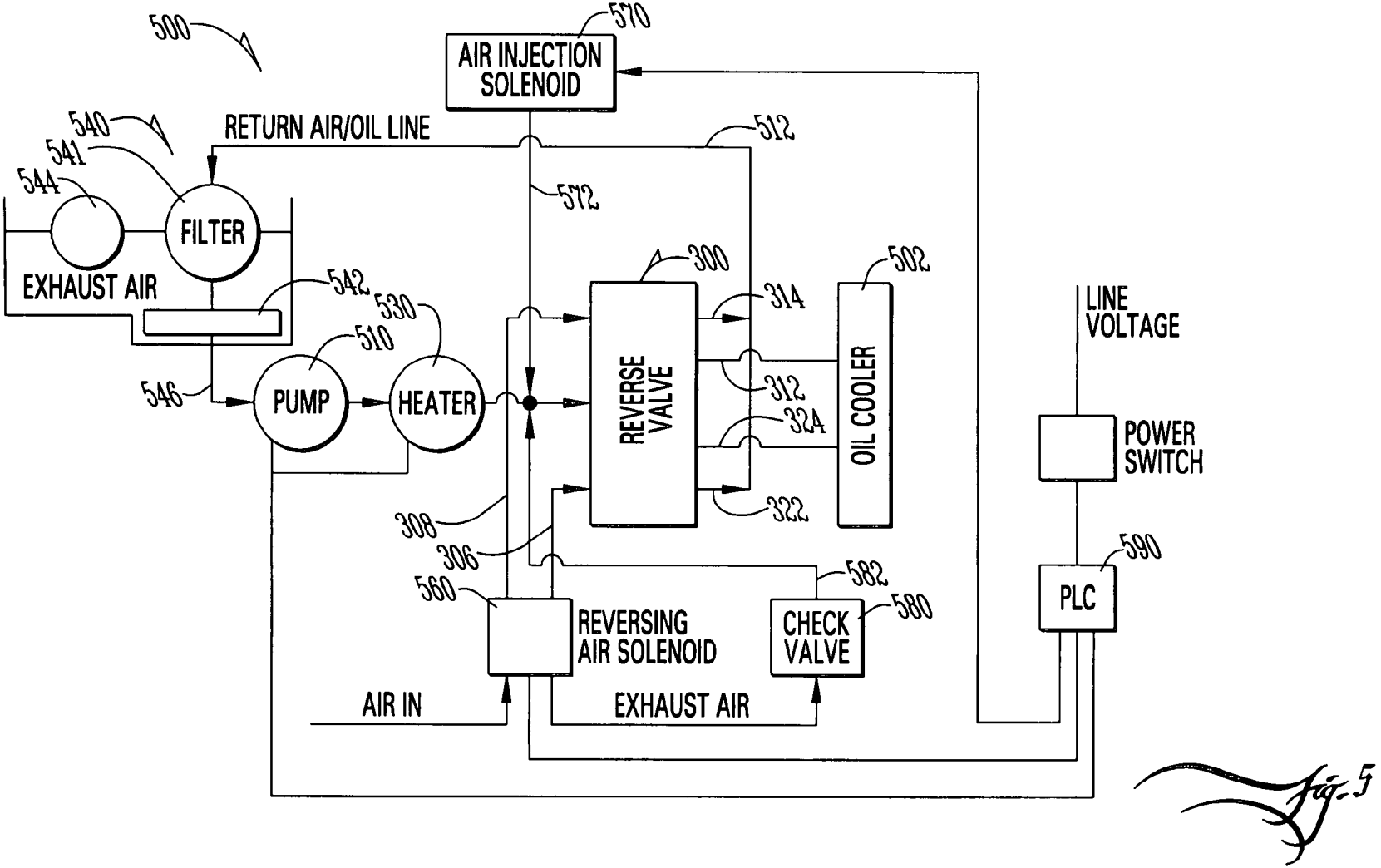
FIG. 5 is a simplified schematic diagram of a system of the present invention which includes the alternating dual-output high-speed valves of FIGS. 3 and 4.

Now referring to FIG. 5, there is shown a simplified schematic diagram of the system of the present invention, generally designated 500, which includes an oil cooler 502 and an oil filter assembly 540, which removes matter from oil entering the filter assembly 540 through line 512 and exiting it through line 546. Pump 510 and heater 530 move and heat the oil respectively. Air is injected into the oil by air injecting solenoid 570 and air supply line 572. Some air may also be injected into the oil via supply line 582, which brings exhaust air from reversing air solenoid 560 through check valve 580. Reversing air solenoid 560 primarily provides compressed air to rapidly switch high-speed valve 300.

During normal operation of a vehicle, the flow direction of oil through the oil cooler 502 is in one direction only. For example, during normal operation of a vehicle containing oil cooler 502, the fluid might flow through it in a direction such as a fluid flowing from port 312 through the cooler 502, and then through port 324. In a preferred embodiment of the method and system of the present invention, the flow of fluid through the oil cooler during cleaning operations is primarily in one direction, and that direction is opposite the direction of normal flow through the oil cooler during operation of the vehicle.

The cooler 502 can be any type of cooler or heat transfer mechanism such as a transmission cooler exposed to air or immersed in engine coolant in an engine radiator. Cooler 502 is also intended to represent a cooling element in an air conditioning system where heat is transferred from air to the circulating air conditioning refrigerant. In such cases, oil represents air condition refrigerant.

The injection of air into the oil may be in micro-pulses which could be less than one (1) second in duration, or other duration. The time between pulses may optimally be on the order of magnitude of five (5) seconds. This step of air injection may be automated by the use of a programmable logic controller (PLC) 590 or electric timers, etc. Other means of regulating the cycling of air injection may be used instead of time, such as flow volume monitoring and flow pressure monitoring. PLC 590 could provide control signals to the air injection solenoid 570, reversing air solenoid 560, pump 510, heater 530 and any other device in the system which could benefit from precision control.

In a preferred method of the present invention, the flow direction may be rapidly changed with the high-speed valve 300. For example, it may be preferred to flow the fluid in one direction for three (3) seconds and then reverse the flow for one-fourth (¼) of a second. The cycle could be repeated numerous times with three (3) seconds in one direction and one-fourth (¼) of a second in the other direction. As stated above, in a preferred embodiment of the present invention, the flow direction of oil through the cooler is primarily in one direction, and it is preferred that the primary flow direction be opposite a flow direction of fluid through the cooler when the cooler is being used in normal operations of a vehicle.

Irrespective of the direction of flow of fluid through the oil cooler 502, the flow of fluid through the filter assembly 540 is always unidirectional. Filter assembly 540 may include a 28-micron filter 541, a 60-micron pre-filter 542 and an exhaust port 544.

Throughout this disclosure and description, the applicant refers to a transmission cooler, oil coolers, transmission fluid, oil and other examples. These references are merely exemplary of the many different types of fluid containers and fluid types which could be utilized in conjunction with the present invention. For example, the present invention is intended to include and address systems for cleaning engine oil from an internal combustion engine, hydraulic oil from a hydraulic system, as well as fluid used in air-conditioning equipment. Various other systems, fluids and containers are contemplated and could be readily substituted, still within the spirit and scope of the present invention.

It is thought that the method and apparatus of the present invention will be understood from the foregoing description, and it will be apparent that various changes may be made in the form, construction, steps and arrangement of the parts and steps thereof without departing from the spirit and scope of the invention or sacrificing all of the material advantages, the form herein described being merely a preferred or exemplary embodiment thereof.

The invention claimed is:

1. A method of removing contaminants from a container in a vehicle, said method comprising the steps of:

determining a flow direction of a first fluid through a container on a vehicle, which container is configured to facilitate heat transfer from the first fluid to a second fluid;

where said container has an inlet end and an outlet end and during operation of the vehicle, the first fluid flows only in one direction, which is from the inlet end to the outlet end;

coupling a filter system to the container;

pumping the first fluid in a primary cleaning flow direction;

reversing a flow of said first fluid through said container;

resuming flow of the first fluid in said primary cleaning flow direction at a time within a predetermined reversal interval from when said step of reversing a flow is commenced;

wherein said predetermined reversal interval is less than 10 seconds; and, repeating said steps of reversing and resuming such that said first fluid flows in a reverse direction for a cumulative reverse direction duration for no more than ten percent of a cumulative primary cleaning direction duration of first fluid flowing in said primary cleaning direction.

2. A method of claim 1 wherein said predetermined reversal interval is less than one second; and, said step of reversing a flow is accomplished with a compressed fluid.

3. A method of claim 2 wherein said compressed fluid is compressed air.

4. A method of claim 2 wherein said step of reversing a flow is accomplished through a compressed fluid used to actuate a compressed fluid driven valve.

5. A method of claim 4 wherein said compressed fluid driven valve causes said step of pumping said first fluid to reverse a flow direction through said container.

6. A method of claim 2 further comprising the step of filtering said first fluid during said step of pumping the first fluid in a primary cleaning flow direction.

7. A method of claim 6 wherein said step of filtering said first fluid is performed by a 28-micron filter.

8. A method of claim 7 wherein a direction of flow of said first fluid through said filter is constant.

9. A method of claim 1 wherein said first fluid is transmission fluid; and, said container is a transmission fluid cooler.

10. A method of claim 9 wherein said second fluid is a fluid circulated around components of an engine of said vehicle.

11. A method of claim 10 wherein said second fluid further is an engine coolant.

12. A method of removing matter from a reservoir in a vehicle, said method comprising the steps of:

providing a reservoir on a vehicle, which reservoir is configured to contain a first fluid which, with the aid of a pump, flows to a plurality of positions within said vehicle;

wherein, during operation of the vehicle, the first fluid flows only in one direction, between said plurality of positions;

coupling a filter system to receive said first fluid;

pumping the first fluid in a first flow direction, which is a primary flow direction;

stopping a flow of said first fluid in said first flow direction;

resuming flow of the first fluid in said first flow direction at a time within a predetermined interval;

wherein said predetermined interval is less than ten (10) seconds and where the first fluid flows primarily in the primary flow direction; and, wherein a compressed second fluid is used in accomplishing said step of stopping a flow of said first fluid.

13. A method of claim 12 wherein said step of stopping a flow of said first fluid is an inherent step in reversing a flow of said first fluid.

14. A method of claim 13 wherein said compressed second fluid is used to actuate a compressed fluid driven valve.

15. A method of claim 12 wherein said compressed second fluid is used to actuate a compressed fluid driven valve.

16. A method of claim 12 wherein said compressed second fluid is compressed air.

17. A method of claim 12 wherein said predetermined interval is less than five (5) seconds.

18. A method of claim 17 wherein said predetermined interval is less than two (2) seconds.

19. A method of claim 18 wherein said predetermined interval is less than one (1) second.

20. A method of claim 12 wherein said first fluid is transmission fluid.

21. A method of removing contaminants from transmission fluid in a vehicle, comprising the steps of:

providing a transmission cooler for exchanging heat between transmission fluid and engine coolant;

pumping, in a dominant flow direction, said transmission fluid from said transmission cooler through a filter to remove contaminants and returning said transmission fluid to said transmission cooler;

temporarily stopping flow of said transmission fluid through said transmission cooler with the aid of compressed air; and resuming flow of said transmission fluid through said transmission cooler after an interval of less than ten (10) seconds and such that the direction of flow of transmission fluid through the transmission cooler which dominates is in the dominant flow direction.

22. A method of claim 21 wherein said step of temporarily stopping flow of said transmission fluid is an inherent step in reversing said flow of said transmission fluid through said transmission cooler.

23. A method of claim 22 wherein the direction of the dominant flow direction of said transmission fluid remains constant despite reversing said flow of said transmission fluid through said transmission cooler.

24. A method of claim 21 wherein the direction of the dominant flow direction of said transmission fluid remains constant despite said step of temporarily stopping flow of said transmission fluid.

* * * * *